US006079429A

United States Patent [19]

Zarich

[11] Patent Number: 6,079,429

[45] Date of Patent: Jun. 27, 2000

[54] PAINT ROLLER CLEANER

[76] Inventor: Ennio Zarich, 455 Wayland, San Francisco, Calif. 94134

[21] Appl. No.: 09/192,344

[22] Filed: Nov. 16, 1998

[51] Int. Cl.[7] ..... B08B 3/04

[52] U.S. Cl. ..... 134/182; 134/900

[58] Field of Search ..... 134/900, 149, 134/152, 154, 170, 182

[56] References Cited

U.S. PATENT DOCUMENTS

| | | | |
|---|---|---|---|
| 2,713,868 | 7/1955 | Lewis | 134/900 X |
| 3,421,527 | 1/1969 | Dettman | 134/182 X |
| 3,577,280 | 5/1971 | George | 134/900 X |
| 4,155,230 | 5/1979 | Lacher, Jr. | 134/900 X |
| 4,380,478 | 4/1983 | Cooney | 134/900 X |
| 4,765,354 | 8/1988 | Thatcher et al. | 134/182 |
| 4,811,749 | 3/1989 | Dixon | 134/900 X |
| 5,163,459 | 11/1992 | Bailey | 134/182 |
| 5,932,028 | 8/1999 | Carrie et al. | 134/138 X |

*Primary Examiner*—Philip R. Coe
*Attorney, Agent, or Firm*—Harris Zimmerman

[57] ABSTRACT

A paint roller cleaner includes a generally tubular housing having one end open and the other end tapered to join a faucet coupling adapted to be releasably secured to a water source. The diameter of the housing is dimensioned to receive the roller with minimum clearance therebetween for pressurized water flow. The length of the housing is slightly greater than the roller. Adjacent to the open end of the housing, a pair of holes are disposed to removably secure a retaining pin. A roller cap includes one end adapted to be removably secured in an open end of the paint roller, and the other end of the cap includes an outwardly protruding, concentrically disposed cone. To use the paint roller cleaner, the roller cap is inserted in one open end of the paint roller The paint roller is placed into the open end of the housing with the capped end thereof extending innermost. Thereafter, a pin is extended through the opposed holes near the open end to retain the paint roller. The faucet adapter is secured to a water source, and water under pressure is admitted into the housing. The protruding conical portion of the cap diverts the water flow uniformly in the radial direction toward the inner surface of the housing and longitudinally between the paint roller core and the inner surface of the housing, due to the minimal clearance therebetween, and thus is directed through the roller nap. The pressurized water flow quickly cleans and flushes the paint from the roller nap fibers, leaving the paint roller clean and ready for reuse.

3 Claims, 3 Drawing Sheets

PAINT ROLLER CLEANER

BACKGROUND OF THE INVENTION

This invention relates generally to devices for cleaning paint rollers, and, more particularly, to a device that can clean a paint roller by direct connection to a faucet with a minimum of manual labor.

The introduction of paint rollers has eased the labor required to paint walls and other surfaces, and has enabled the average individual to achieve generally excellent results. Attendant with the use of paint rollers is the question of how best to clean the roller for re-use, assuming that using a paint roller once and then disposing of it is both expensive and wasteful of resources.

A typical paint roller assembly is comprised of a cylindrical sleeve formed of generally rigid material, with a tufted or fibrous nap secured to the outer circumferential surface. The sleeve is generally removably secured to an inner mandrel or wire frame that is rotatably secured to a handle. After a paint roller has been used, the nap is saturated with paint, and the paint must be removed before it dries if the roller is to be reused. It is common practice to manually removed the sleeve from the mandrel, and rinse the sleeve in solvent appropriate for the type of paint being used. For water-based paints, such as latex compounds, the roller sleeve may be held under the stream of water from a faucet or hose while the nap is rubbed manually to work the paint free of the fibers. This process is very messy, time consuming, and unpleasant.

There are known in the prior art several forms of paint roller cleaners that are designed to ease the process of cleaning the paint from the roller sleeve nap so that it may be re-used. For example, in U.S. Pat. No. 3,577,280, there is described a paint roller cleaning apparatus in which the roller is supported in a tubular housing while water under pressure is fed through a manifold having holes that direct fine streams of water against the outer surface of the roller sleeve. The individual streams do not provide complete coverage of the surface of the roller sleeve, even though the roller is driven by the streams to rotate, nor do the holes allow for maximum water flow to carry away the paint in the nap.

U.S. Pat. Nos. 3, 421,527, 4,765,354, and 4,811,749, paint roller cleaners are described which include a tubular housing connected to a water source, and the water is directed to flow longitudinally along the inner surface of the tube and through the roller sleeve nap to remove the paint therefrom. The water enters the tubular housing at one end, where it is divided to flow radially outwardly toward the inner surface of the housing. One problem common to these designs is that the radial flow and the resultant longitudinal flow is not uniform, resulting in a cleaning effect that is not uniform about the roller sleeve. There remains a need in the art for a paint roller cleaner that is simple to use, reliable, and effective.

SUMMARY OF THE INVENTION

The present invention generally comprises a paint roller cleaner designed to be easier to use, more effective, and simpler than comparable prior art devices. The paint roller cleaner includes a generally tubular housing having one end open and the other end tapered to join a faucet coupling adapted to be releasably secured to a water faucet, hose outlet, or the like. The diameter of the tubular housing is dimensioned to receive the outer diameter of a paint roller or roller sleeve with minimum clearance therebetween for pressurized water flow. The length of the housing is slightly greater than a paint roller or roller sleeve. Adjacent to the open end of the housing, a pair of diametrically opposed holes are disposed to removably secure a retaining pin.

The paint roller cleaner further includes a cap having one end adapted to be removably secured in an open end of the paint roller or roller sleeve. The inner end of the cap is tapered slightly to be frictionally retained in the open end of the roller, and the outer end of the cap is provided with an outwardly protruding, concentrically arranged conical configuration.

To employ the paint roller cleaner, a used paint roller is removed from its handle assembly, and the cap is secured with the inner end thereof frictionally engaged in one open end of the used paint roller or roller sleeve (hereinafter, paint roller). The paint roller is then placed into the open end of the housing with the capped end thereof extending innermost toward the faucet coupling. The minimal clearance between the paint roller and the inner diameter of the housing assures concentricity of the two components. Thereafter, a pin is extended through the opposed holes near the open end to retain the paint roller within the housing. The faucet adapter is then secured to a water faucet or hose, and water under pressure is admitted into the housing. The water flows toward the protruding conical portion of the cap, which diverts the water flow uniformly in the radial direction toward the inner surface of the housing. The water flows longitudinally in the housing between the paint roller core and the inner surface of the housing, due to the minimal clearance therebetween, and thus is directed through the roller nap. The pressurized water flow quickly cleans and flushes the paint from the roller nap fibers, leaving the paint roller clean and ready for reuse or for drying and storage. The roller is removed from the housing by removing the pin and sliding the roller from the housing, and finally removing the cap from the end of the roller.

For "mini-roller" paint rollers, which have one open end and an opposed sealed end, the process described above is used, with one exception: The sealed end of the mini-roller may be inserted into the open end of the housing without placing the cap thereon. The cap is not necessary, as the water flow will be diverted generally uniformly in the radial direction by the sealed end wall of the mini-roller.

DESCRIPTION OF THE PREFERRED EMBODIMENT

Figure 1:
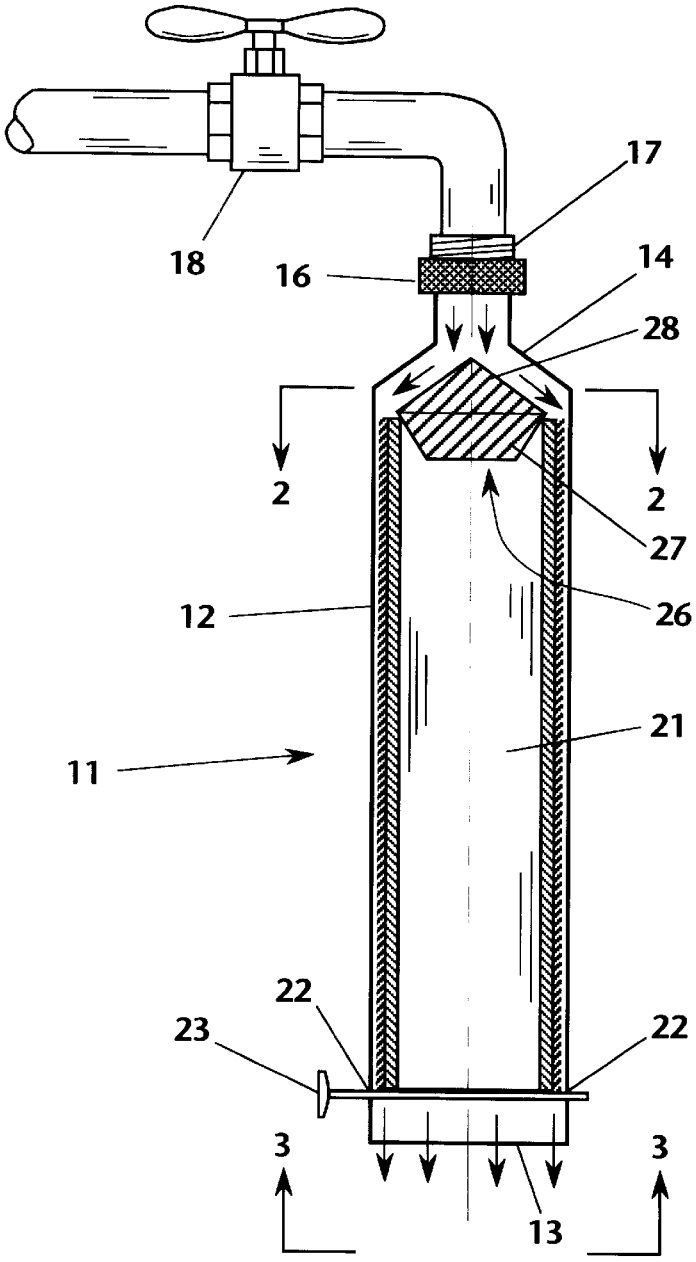
FIG. 1 is a cross-sectional side view showing the paint roller cleaner apparatus secured to a faucet and in use.
Figure 2:
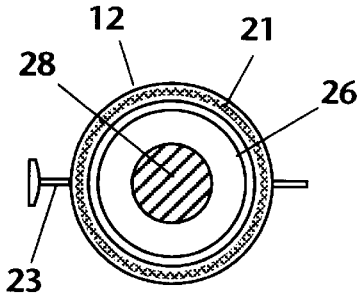
FIG. 2 is a cross-sectional view of the paint roller cleaner apparatus, taken along line 2—2 of FIG. 1.
Figure 3:
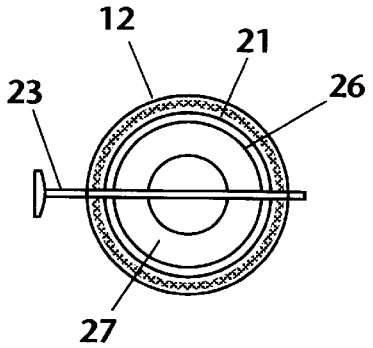
FIG. 3 is an end view of the paint roller cleaner apparatus, taken along line 3—3 of FIG. 1.
Figure 4:
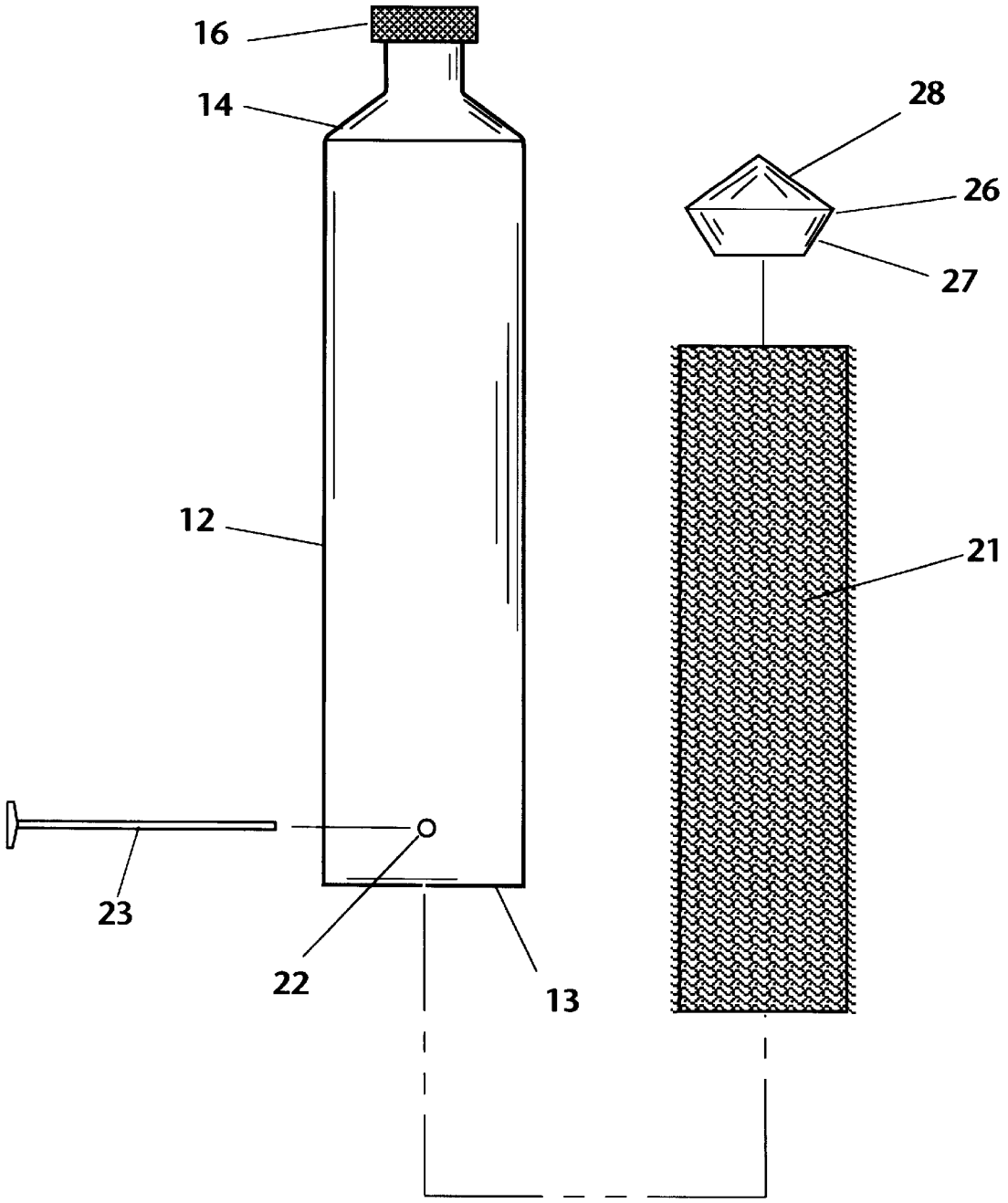
FIG. 4 is an exploded plan view of the paint roller cleaner of the invention.

The present invention generally comprises a paint roller cleaner for removing paint from the nap or fiber of a paint roller. With reference to FIGS. 1–4, the paint roller cleaner apparatus 11 includes a tubular housing 12 having one open end 13. The opposed end 14 is tapered to join an internally threaded female coupling 16 which is adapted to be secured to the male threaded end 17 of a faucet valve 18, or to a hose bib, hose end connection, or the like. The housing 12 is generally cylindrical and is provided with a diameter that is minimally sufficient to slidably receive a typical paint roller 21 with the nap thereof in contact with the inner surface of the housing 12. The length of the cylindrical portion of the housing 12 is slightly greater than a typical paint roller. Adjacent to the open end 13 of the housing 12, a pair of diametrically opposed holes 22 are disposed to slidably secure a retaining pin 23. The pin 23, in its simplest form, may comprise a corrosion-resistant spike.

A further component of the paint roller cleaner apparatus is a cap 26. The cap 26 includes one end 27 tapered in a right frusto-conical configuration. The opposed end 28 comprises an outwardly protruding cone, and the ends 27 and 28 are disposed in axial alignment. The end 27 is dimensioned to be inserted into an open end of a typical paint roller and releasably retained therein by frictional engagement.

To use the paint roller cleaner apparatus 11, a used paint roller 21 is removed from its handle assembly, and the cap 26 is secured with the inner end 27 thereof frictionally engaged in one open end of the used paint roller 21. The paint roller 21 is then inserted into the open end 13 of the housing 12, with the capped end thereof extending innermost toward the tapered end 14. The minimal clearance between the paint roller 21 and the inner diameter of the housing 12 assures concentricity of these two components. Thereafter, the pin 23 is extended through the opposed holes 22 to retain the paint roller within the housing. The threaded end connection 16 is then secured to the male threaded connector 17 of a water faucet 18 or a hose, and water under pressure is admitted into the housing.

The water flows toward the protruding conical portion 28 of the cap 26, which diverts the water flow uniformly in the radial direction toward the inner surface of the housing 12. The water flows longitudinally in the housing 12 between the paint roller core and the inner surface of the housing, due to the minimal clearance therebetween, and thus is directed through the roller nap. The pressurized water flow quickly cleans and flushes the paint from the roller nap fibers, leaving the paint roller clean and ready for reuse or for drying and storage. The roller is removed from the housing by removing the pin 23 and sliding the roller 21 from the housing 12. Finally, the cap 26 is removed from the end of the roller 21, and the apparatus 11 is then available for another cycle of paint roller cleaning.

Figure 5:
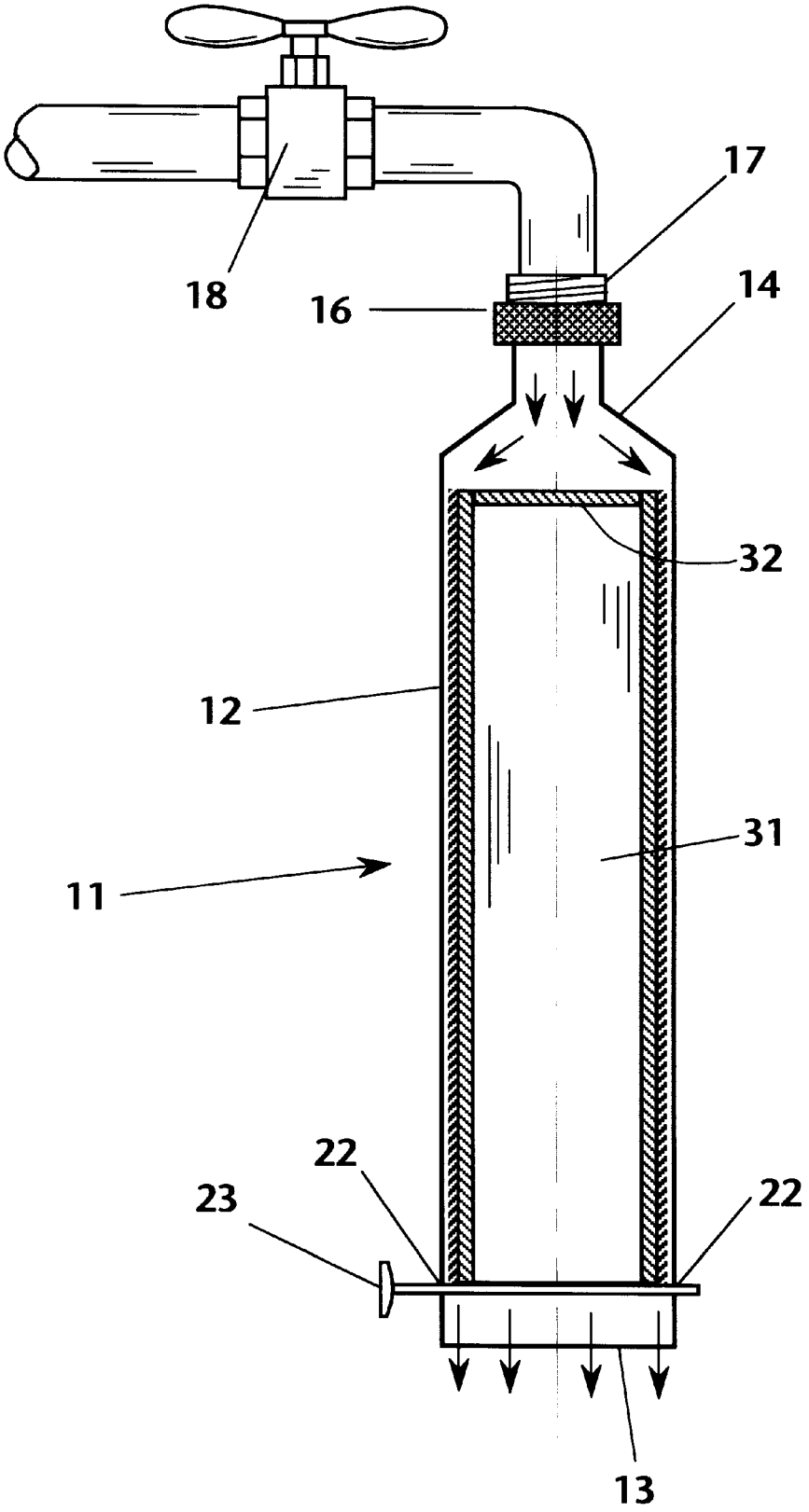
FIG. 5 is a cross-sectional side view of a further embodiment of the paint roller cleaner apparatus secured to a faucet and in use.

With regard to FIG. 5, the apparatus 11 may be adapted for use with a "mini-roller" paint roller 31, which is typically provided with one open end and opposed sealed end 32. The sealed end 32 of the mini-roller may be inserted into the open end 13 of the housing 12 without placing the cap 26 thereon. The cap is not necessary, as the water flow will be diverted generally uniformly in the radial direction by the sealed end wall of the mini-roller. Alternatively, the cap may be used in conjunction with the open end of the roller 31, which would then be inserted innermost into the housing 12.

A important advantage of the paint roller apparatus 11 is that it uses significantly less water than manual roller washing, and provides similar water savings in comparison with prior art roller cleaning devices. Furthermore, it provides better cleaning, and it is simpler and cheaper to manufacture than comparable prior art devices.

The apparatus may provide a quick disconnect mechanism instead of the threaded end connection to achieve even greater economy of time and effort. The housing and associated structures may be formed of plastic or polymer material, such as PVC, ABS, Polyethylene, or the like.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A paint roller cleaning apparatus including:

a tubular housing having an axial length greater than the paint roller which is to be cleaned therein;

a first end of said housing being open;

said tubular housing having a diameter sufficiently large to freely receive said paint roller;

a second end of said housing having a portion converging outwardly from said second end;

a distal end of said second end portion having means thereon for releasable attachment to a source of pressurized fluid;

said housing axially receiving said paint roller inserted through said open end so that the innermost portion of the paint roller is disposed adjacent said second end of said housing and the outermost portion of the paint roller is disposed entirely withiin said housing and spaced inwardly of said open end;

a cap having a first portion releasably and sealingly engaging an open end of said innermost portion of said paint roller and a second portion of conical configuration extending towards said second end of said housing whereby fluid from said pressurized fluid source will be directed substantially uniformly towards the inner wall of said tubular housing;

and means for releasably retaining said paint roller entirely within said housing including a pin releasably extending diametrically through said housing and engaging the outermost end of said paint roller, said pin being adapted to be pulled out of said housing to remove said paint roller.

2. The apparatus as set forth in claim 1 in which said first portion of said cap is of frusto-conical configuration with its largest diameter larger than the open end of said paint roller, and in which said second portion of said cap is of a conical configuration with its largest diameter substantially the same as the largest diameter of said first cap portion.

3. Apparatus as set forth in claim 2 in which said first and second cap portions have a common axis coaxial with the axis of said housing.

* * * * *